United States Patent [19]

Erard

[11] Patent Number: 4,541,343

[45] Date of Patent: Sep. 17, 1985

[54] ADJUSTABLE TELEVISION/VIDEO RECORDER STAND INCORPORATING A CASSETTE-HOLDER

[76] Inventor: Henri Erard, 26 Rue du Gambaud, Tignieu-FR 38230 Pont de Cheruy, France

[21] Appl. No.: 543,544

[22] Filed: Oct. 19, 1983

[30] Foreign Application Priority Data

Oct. 22, 1982 [FR] France ..... 82 18037

[51] Int. Cl.[4] ..... A47B 81/06

[52] U.S. Cl. ..... 108/92; 108/59; 108/149; 108/150; 312/7.2; 312/254

[58] Field of Search ..... 108/59, 92, 93, 106, 108/149, 150, 151; 211/107, 133; 248/176; 312/250, 254

[56] References Cited

U.S. PATENT DOCUMENTS

| | | | |
|---|---|---|---|
| 212,995 | 3/1879 | Smith | 108/92 |
| 1,257,586 | 2/1918 | Deming | 248/457 |
| 1,598,849 | 9/1926 | Colby | 108/92 X |
| 3,896,744 | 7/1975 | Goebl | 108/150 X |

FOREIGN PATENT DOCUMENTS

| | | | |
|---|---|---|---|
| 1296006 | 5/1962 | France | 108/93 |
| 2462124 | 3/1981 | France | 108/150 |

*Primary Examiner*—William E. Lyddane
*Assistant Examiner*—Peter R. Brown
*Attorney, Agent, or Firm*—Dowell & Dowell

[57] ABSTRACT

The invention relates to an adjustable television/video recorder stand incorporating a cassette-holder, wherein the two adjustable shelves adapted to receive the television set and the video recorder are arranged on two crossbars connected to each other by lateral uprights whose lower ends support a tray for storing video cassettes.

2 Claims, 2 Drawing Figures

ADJUSTABLE TELEVISION/VIDEO RECORDER STAND INCORPORATING A CASSETTE-HOLDER

The present invention relates to supports or stands provided with two superposed shelves adapted to receive a television set and a video recorder.

It is known that, in stands of this type, the lower shelf which is to receive the video recorder generally comprises a fixed element rigidly mounted on the top of the conventional vertical tube of the underframe, this fixed element cooperating with adjustable elements to constitute the lower shelf adapted to receive the video recorder. Said fixed element, at its rear, is fixed to two columns which support the upper shelf for the television set, this shelf itself being adjustable so as to be adapted to the different sets on the market.

It will be readily appreciated that the assembly thus constituted is fairly unstable, due in particular to the overhanging structure of the upper shelf which supports a relatively heavy weight. Furthermore, it will be observed that the fixedness of the element which bears the columns supporting the upper shelf is a hindrance to and in any case limits the adjustment of the lower shelf, so that the latter can be adapted to the dimensions of the different types of video recorders only with difficulty.

It is the principal object of the present invention to overcome these drawbacks, by producting a two-shelf stand of highly robust and stable structure, whilst at the same time allowing each shelf to adjustable.

It is further object of the invention to provide a stand of the above type, which carries, below the lower shelf, a tray adapted to receive the cassettes to be used with the video recorder.

The stand according to the invention is essentially characterized in that the conventional underframe is fixed to a rigid frame comprising the superposed horizontal crossbars joined to each other by two laterally spaced uprignts. The lower crossbar which bears the moveable elements of the adjustable lower shelf is directly fixed to the top of the vertical tube of the underframe, whilst the upper crossbar receives the elements which compose the adjustable upper shelf. The uprights of the frame extend downwards to beneath the lower crossbar and their ends support a cassette receiving tray whose central part is advantageously fixed to the tube of the underframe.

It will be readily appreciated that a robust, rigid stand which does not give rise to any undesirable oscillation, is thus produced.

The invention will be more readily understood on reading the following description with reference to the accompanying drawings, in which.

Figure 1:
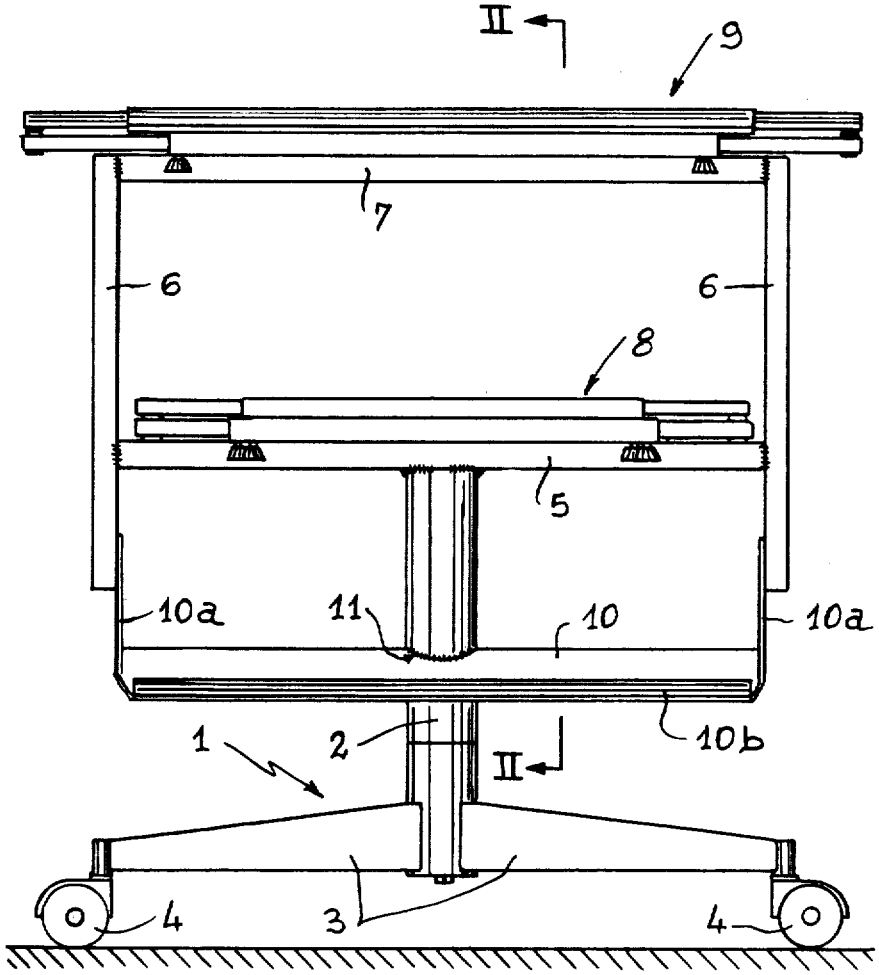
FIG. 1 is a view in elevation of a stand according to the invention.
Figure 2:
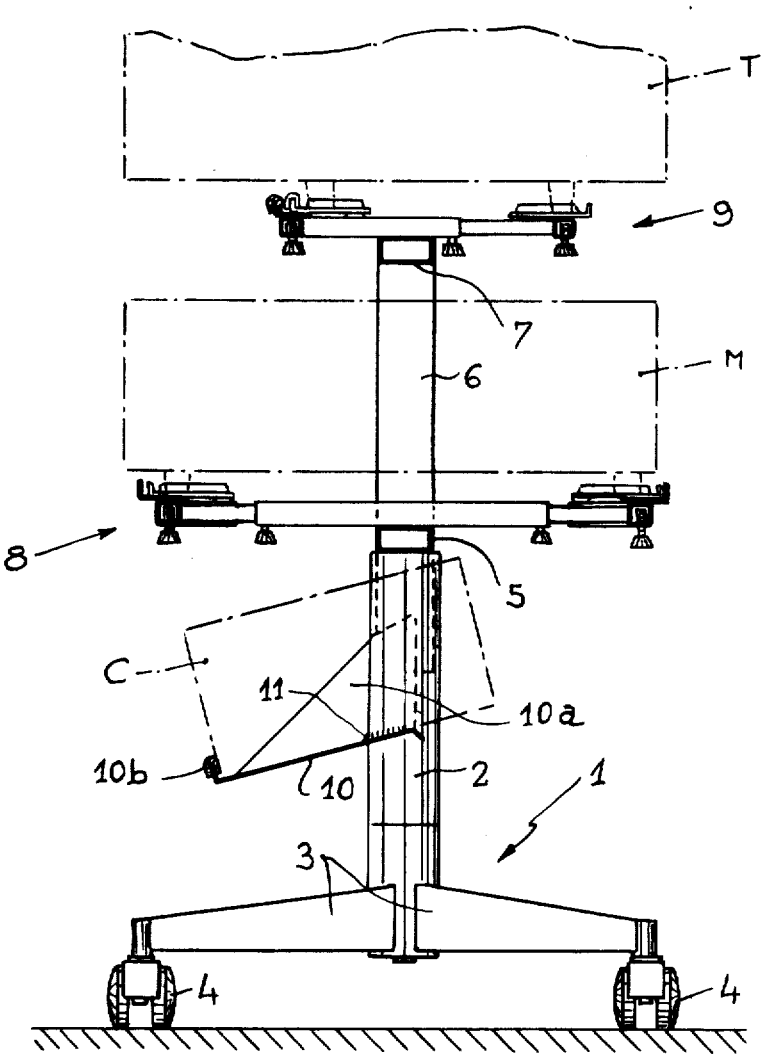
FIG. 2 is a schematic vertical section along II—II in FIG. 1.

Referring now to the drawings, the stand according to the invention comprises an underframe 1 of conventional type, formed by the assembly of a vertical tube 2 and a series of radial arms 3 whose free ends are equipped with casters 4. On the upper end of tube 2 of this underframe 1 there is connected, by welding in the embodiment illustrated, a horizontal lower crossbar 5 constituted in the present case by a box section. Each of the ends of crossbar 5 is welded to an upright 6 formed by an identical section, and the two uprights 6 are connected together by an upper crossbar 7 disposed in the vertical plane defined by tube 2 and the lower crossbar 5.

On each of crossbars 5 and 7 the is arranged an adjustable shelf 8 and 9, respectively. The arrangement of these shelves has not been shown in detail as it may be of any known type. It will simply be mentioned that each shelf 8 or 9 comprises a fixed part welded to the corresponding crossbar and moveable elements adapted to be immobilized with the aid of screws in the position chosen, these moveable elements bearing four independent shoes adapted to be adjusted to receive the feet or base of the television set T and the video recorder M with which the stand according to the invention is associated.

The two uprights 6 extend downwards to beneath the lower crossbar 5 and are attached to and serve as the suspension of a horizontal tray 10 provided with lateral lugs **10*a* welded to the free ends of said uprights. This tray 10 is advantageously oriented obliquely to the tube 2 so as to facilitate storage of a series of video cassettes C, retained by a front flange 10*b*. It should be observed that its central part is notched in order to leave room for tube 2 of underframe 1, said tray 10 being welded to said tube, as indicated at 11 in FIG. 1**.

It will be understood that components 5, 6 and 7 constitute a rigid frame which is further stiffened by the tray 10 fixed to tube 2. The frame 5-6-7 thus formed is consequently safe from any bending or undesirable deformation, despite the weight of the television set T resting on the upper part of the assembly.

As indicated above, shelves 8 and 9 may be arranged as desired, so that the front faces of the television set T and of the video recorder M can be brought into vertical alignment, this improving the aesthetic appearance of the stand as a whole.

It is obvious that the foregoing description has been given only by way of example and that it in no way limits the domain of the invention which would not be exceeded by replacing the details of execution described by any other equivalents. In particular, the tray 10 may be especially arranged to store the cassettes C in any reasonable manner.

What is claimed is:

1. A stand having adjustable shelves for supporting a television set and a video recorder and having a tray for supporting cassettes, comprising:

an underframe comprising a vertically disposed tube having an upper end and having a lower end carrying multiple radially extending arms for supporting the underframe on the ground;

a first horizontal crossbar fixed across the underframe at said upper end of the tube;

two laterally spaced uprights fixed to said first crossbar at its ends and disposed parallel with said tube substantially in a common vertical plane therewith, the uprights respectively having upper and lower ends disposed above and below said first crossbar;

a second horizontal crossbar fixed at its ends to the upper ends of said uprights;

vertically spaced shelf means respectively carried by said first and second crossbars and respectively adjustable to support the television set and video recorder; and a cassette supporting tray extending across the underframe beneath the first crossbar and fixed to the respective lower ends of the uprights, the crossbars and the uprights and the tray forming a rigid frame.

2. The stand as claimed in claim 1, wherein the cassette tray extends across the vertically disposed tube of the underframe and is fixed thereto to stiffen said rigid frame thereon.

* * * * *